US005396725A

United States Patent [19]

Talbot

[11] Patent Number: 5,396,725

[45] Date of Patent: Mar. 14, 1995

[54] QUICK DETACHABLE MOUNT

[76] Inventor: Alfred R. Talbot, 2210 E. Grand Blanc Rd., Grand Blanc, Mich. 48439

[21] Appl. No.: 213,765

[22] Filed: Mar. 16, 1994

[51] Int. Cl.[6] ..... F41G 1/38

[52] U.S. Cl. ..... 42/101

[58] Field of Search ..... 42/101; 33/250

[56] References Cited

U.S. PATENT DOCUMENTS 4,205,473 6/1980 Wilson ..... 42/101

5,274,941 1/1994 Moore ..... 42/101

FOREIGN PATENT DOCUMENTS 5492 10/1956 Germany ..... 33/250

*Primary Examiner*—Charles T. Jordan

*Assistant Examiner*—Theresa M. Wesson

*Attorney, Agent, or Firm*—Donald C. Bolger

[57] ABSTRACT

The quick detachable gun sight mount has a front base, a rear slide base and a rear slide. The front base is mounted to the gun receiver with two screws. The front base has a slot to receive a dovetail mount at the rear portion of the slot and then lock in place when the dovetail is moved to the tapered forward portion of the slot. The rear slide base is also mounted to the gun receiver with two screws. The rear slide has two holes at the rear to retain two springs, two balls, and a hole for securing the rear slide base. The rear slide has a channel cross section which allows the rear slide to move forward and rearward on the slide base. The rear slide also has a slot to receive a dovetail mount at the front portion of the slot and then lock in place when the slide is moved to the tapered forward portion. Two springs are used to create a force between the slide and the rear slide base. The slide also has an elongated hole for a securing screw which is fastened to the rear base. The slide has a horizontal hole in the front portion housing a pin which locks the slide in place. To use the mechanism, a scope with two dovetail mounts is tipped rearward so the rear dovetail is inserted into the rear slide slot. The scope is then pulled to the rear, and then the front dovetail is inserted into the front base slot. The slide is then moved forward and locked in place with a pin. To remove the sight, the pin is pushed to the left, and the slide moved rearward. The dovetail at the front of the scope is moved upward, out of the slot, and then the rear dovetail is moved upward and out of the rear slide slot.

3 Claims, 2 Drawing Sheets

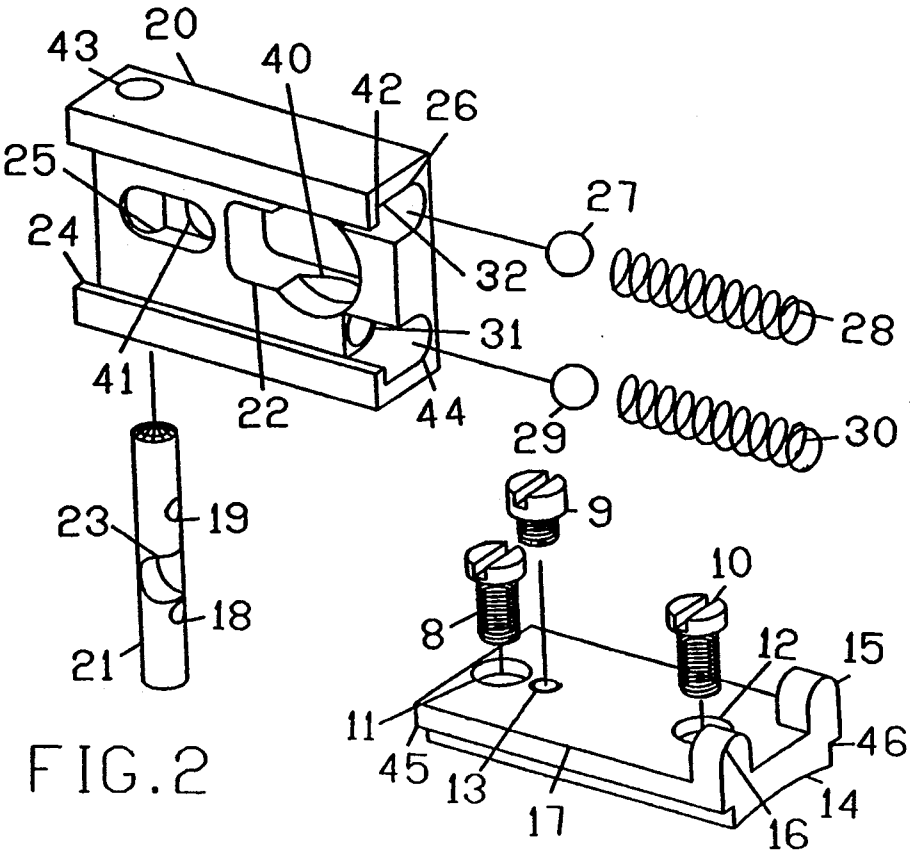
FIG. 2
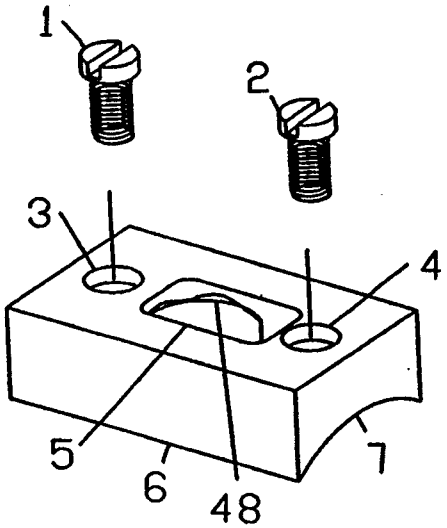

QUICK DETACHABLE MOUNT

BACKGROUND OF THE INVENTION

The present invention relates generally to a quick detachable mounting system and more specifically to a detachable scope mount assembly for rifles, pistols and other firearms.

Telescopic or scope sights are a widely used optional accessory for firearms, particularly rifles, and facilitate the accurate aiming of such firearms. As the range and accuracy of firearms such as rifles and pistols has increased, the popularity of telescopic sights has also increased.

Such scope sights generally contain cross hairs mounted internally therein which are associated with an external means for adjusting the cross hairs to zero the scope sights in the assembled position for range, wind, drift, and weight charge of the bullet.

Important considerations in providing a scope sight mount are the simplicity and security of the mount. The ease with which a scope sight may be mounted or dismounted is desirable since the sight can be separately stored from the firearm. It is also desirable to have a mounting system so that different sights may be interchanged with the mount or different sights with dedicated mounts may be interchanged upon the firearm.

It is critical that a scope sight be securely mounted to a firearm. The line of sight of a securely mounted scope sight may be adjusted once for the particular rifle and need not be adjusted again. Less stable mounting devices would cause mis-aiming or would require continuous adjustment as the firearm is carried and fired.

It is also important for a scope mount sight to have a relatively low profile, so that the line of sight of the scope sight is as close as possible to the firing axis of the firearm, increasing the accuracy of the sighting mechanism.

Scope mountings have been sought for years that are readily detachable and remained zeroed after detaching and re-attaching.

SUMMARY OF THE INVENTION

The present invention has a front base, a rear slide base and a rear slide. The front base is mounted to the gun receiver with two screws. The front base has a slot tapered to receive a dovetail mount at the front portion of the slot and then lock in place when the dovetail is moved to the forward angled portion of the slot. The rear slide base is also mounted to the gun receiver with two screws. The rear slide has two holes at the rear to retain two springs and two balls and a threaded hole for securing the rear slide. The rear slide has a channel cross section which allows the rear slide to move forward and rearward on the slide base. The rear slide also has a slot tapered to receive a dovetail mount at the rear portion of the slot and then lock in place when the slide is moved to the forward position. Two springs are used to create a force between the slide and the rear slide base. The slide also has an elongated hole for a securing screw which is fastened to the rear base. The slide has a horizontal hole in the front portion containing a notched pin which locks the slide in place.

To use the mechanism, a scope with two dovetail mounts is tipped rearward so the rear dovetail is inserted into the rear slide. The slide is then moved rearward, allowing the front dovetail to enter the front base. The slide then moves forward and locks in place with a pin. To remove the sight, the pin is pressed to the unlock position and the slide moved rearward and the dovetail at the front of the scope is moved upward out of the front base and then the rear dovetail is moved up and out of the rear slide.

It is an object of the invention to provide a scope mount which can be quickly and easily removed and replaced without the use of tools of any kind.

It is another object of the invention to provide a scope mount which can be quickly and easily removed and replaced without the use of separate fastening means.

It is a further object of the invention to provide a scope mount which can be removed and replaced without need for adjusting the accuracy of the sight.

It is another object of the invention to provide a scope mount so that the scope can be removed and replaced in a very short amount of time.

It is a further object of the invention to provide a scope mount which is accurate and reliable after installing and removing many times.

Further objects are implicit in the detailed description which follows hereinafter (which is to be considered as exemplary of, but not specifically limiting, the present invention) and said objects will be apparent to persons skilled in the art after a careful study of the detailed description which follows.

For the purpose of clarifying the nature of the present invention, one exemplary embodiment of the invention is illustrated in the hereinbelow-described figures of the accompanying drawings and is described in detail hereinafter. It is to be taken as representative of the multiple embodiments of the invention which lie within the scope of the invention.

BRIEF DESCRIPTION OF THE DRAWING

FIG. 2 is a perspective view showing one exemplary embodiment of one representative form of the invention.

DESCRIPTION OF THE PREFERRED EMBODIMENTS

Figure 1:
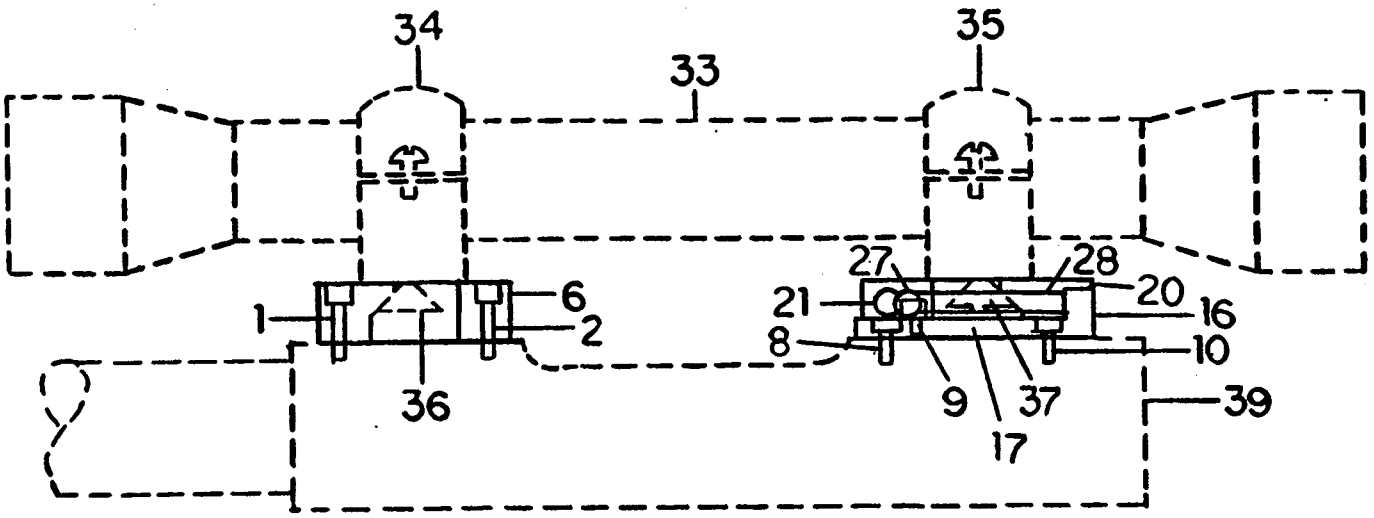
FIG. 1 is an elevation view showing one exemplary embodiment of one representative form of the invention.

Referring to FIG. 1, scope 33 is mounted with front scope ring 34 having dovetail 36 and rear scope ring 35 having dovetail 37. Receiver 39 has front base 6 attached at front of receiver 39 with screw 1 and screw 2. Rear slide base 17 is attached to rear of receiver 39 using screw 8 and screw 10.

Referring to FIG. 2, front base 6 has curved surface 7, corresponding to a particular rifle. Front base 6 has screw hole 3 and screw hole 4 corresponding to tapped holes in a particular rifle. Front base 6 has elongated slot 5 to permit insertion of dovetail 36 (FIG. 1). Cone surface 48 of elongated slot 5 is cone shaped inside to correspond to cone shaped front surface (FIG. 1) of dovetail 36. When dovetail 36 is pressed firmly forward, engaging cone surface 48, front scope ring 34 is aligned with and held down securely to the top surface of front base 6.

Rear slide base 17 has ear 15 and ear 16 to engage spring 28 and spring 30. Rear slide base 17 also has curved surface 14 corresponding to above particular rifle receiver 39. Rear slide base 17 has screw hole 11 and screw hole 12, corresponding to tapped holes in receiver 39 (FIG. 1). Rear slide base 17 has tapped hole 13 to receive screw 9. Screw 9 is inserted thru hole 41 upon assembly of rear slide base 17 and slide 20 to secure assembly and act as a travel block when lock pin 21 is in locked position. Rear slide base 17 also has gib 45 and gib 46 which slide in guideway 42 and guideway 24 respectively.

Rear slide 20 has guideway 24 and guideway 42 to accept insertion of rear slide base 17, allowing forward and rearward travel as limited by screw 9 traveling in slot 25 of rear slide 20. Hole 31 and hole 32 in rear slide 20 are drilled thru to intersect hole 43 which is drilled transversely completely thru rear slide 20. Lock pin 21 is contained within hole 43 of rear slide 20. Passage way 26 and passage way 44 are machined to accept insertion of ear 15 and ear 16 (FIG. 2) on rearward part of rear slide base 17. Ear 15 and ear 16 engage ends of spring 28 and spring 30 upon assembly of rear slide 20 and rear slide base 17. Slot 22 of rear slide 20 accepts insertion of dovetail 37. Rear portion 40 of slot 22 is cone shaped to mate with rear surface of dovetail 37. Forward pressure of slide 20 against dovetail 37 aligns dovetail 37 with and firmly down on top surface of rear slide 20.

Referring to FIG. 2, lock pin 21 is a solid pin whose length is somewhat greater than the width of slide 20. Lock pin 21 is inserted in hole 43 within rear slide 20. If lock pin 21 is pushed flush with one surface of rear slide 20, it will protrude from the opposite side. Lock pin 21 is machined with detents 18 and 19 and notch 23. When lock pin 21 is pushed to the right, detent 18 aligns with spring hole 31, engaging spring loaded ball 29, keeping lock pin 21 in this position, and keeping notch 23 out of alignment with slot 25 in rear slide 20. Lock pin 21 now blocks rearward travel of rear slide 20 by contacting screw 9. When lock pin 21 is pushed to the left, detent 19 aligns with spring hole 32, engaging spring loaded ball 27 and keeping lock pin 21 in this position. Notch 23 is now in alignment with screw 9 and slot 25 in rear slide 20. This effectively lengthens slot 25, allowing full rearward travel of rear slide 20 upon rear slide base 17. Full travel is necessary when removing or replacing scope 33. Blocking of the rearward travel is necessary when the firearm is in use.

Ball 27 and ball 29 are inserted in hole 31 and hole 32 respectively, and contact lock pin 21 at detent 18 or detent 19, depending on position of lock pin 21. The pressure from springs 28 and 30 keeps lock pin 21 in the desired position and dovetails secured to respective bases.

Initial assembly requires front base 6 to be securely fastened to receiver 39 by screw 1 and screw 2. Rear slide base 17 is then securely fastened to the rear of receiver 39 by screw 8 and screw 10. Lock pin 21 is inserted in hole 43 of rear slide 20, taking care to align detent 18 and detent 19 and to align notch 23 with slot 25 in slide 20. Next, ball 27 and ball 29 are inserted into hole 31 and hole 32 respectively, followed by spring 28 and spring 30. Next, rear slide 20 is positioned onto rear slide base 17 and move rearward. As tapped hole 13 in rear slide base 17 becomes visible through hole 41 in rear slide 20, spring 28 and spring 30 will contact ear 15 and ear 16 on rear of rear slide base 17. Next, rear slide 20 is compressed onto rear slide base 17 until hole 13 is visible. Next, screw 9 is inserted thru hole 41 in slide 20 and securely tighten in hole 13.

Front scope ring 34 and rear scope ring 35 are to be assembled with very light screw pressure to allow front scope ring 34 and rear scope ring 35 to be positioned on scope 33 for proper eye relief (eye distance) and cross hair orientation to the satisfaction of the shooter. When this has been accomplished rear scope ring 35 screws should be securely tightened.

At this point lock pin 21 is pressed to the right, limiting travel to rear of rear slide 20. Next, scope 33 is grasped at rear scope ring 35 and firmly pulled rearward to firm contact between screw 9 and lock pin 21. While holding in this position, front scope ring 34 is slid firmly forward so dovetail 36 engages front base 6 cone surface 48. Next, front scope ring 34 is tightened onto scope 33. Scope 33 is now pressed fully forward by rear slide 20 and is blocked to any rearward travel by contact between lock pin 21 and screw 9. To remove scope 33, lock pin 21 is pressed to the left, aligning lock pin 21, notch 23 with slot 25 in rear slide 20 and screw 9. Scope 33 can now be pulled rearward, disengaging front scope ring 34 and dovetail 36 from front base 6 cone surface 48 and elongated slot 5. Dovetail 36 now tips up and out of front base 6 and elongated slot 5. Rear scope ring 35 and dovetail 37 are now tipping upward, and scope 33 is released from rear slide 20 and receiver 39 of firearm.

To reinstall scope 33 dovetail 37 is inserted into slot 22. Next, dovetail 36 is lowered to contact top of front base 6. Next, scope 33 is pulled rearward until dovetail 36 drops into elongated slot 5. Next, springs 28 and 30 push rear slide 20 forward which secures dovetail 36 and 37 in a fixed position. Next, lock pin 21 is moved to the right and the rifle is ready for use.

What is claimed is:

1. A quick detachable mount mechanism for attaching to a dovetail mount having a front dovetail and a rear dovetail to a receiver comprising:

a front base having an elongated slot with a cone surface, at least one screw hole, and a curved lower surface;

a rear slide base having at least one hole, a tapped hole, at least one ear, a first gib, a second gib, and a curved surface;

a locking pin having at least one detent and a notch;

at least one spring;

a rear slide having a hole to receive said locking pin, a first passage way and hole for receiving a ball and said spring, a first guide way for receiving said first gib, a second guide way for receiving said second gib, and a slot;

means for attaching said front base to a receiver;

means for attaching said rear slide base to said receiver;

means for attaching said rear slide to said rear slide base whereby said rear slide guideways slide in said rear slide base gibs and said spring is compressed against said rear slide base ear and retained by said locking pin.

2. A quick detachable gun sight mount mechanism for attaching to a dovetail sight mount having a front dovetail and a rear dovetail to a gun receiver comprising:

a front base having an elongated slot with a cone surface, two screw holes, and a curved lower surface;

a rear slide base having two holes, a tapped hole, a first ear, a second ear, a first gib, a second gib, and a curved surface;

a locking pin having two detents and a notch;

at least one spring;

at least one ball;

a rear slide having a hole to receive said locking pin, a passage way and hole for receiving said ball and said spring, a first guide way for receiving said first gib, a second guide way for receiving said second gib, and a slot;

means for attaching said front base to a gun receiver;

means for attaching said rear slide base to said gun receiver;

means for attaching said rear slide to said rear slide base whereby said rear slide guideways slide in said rear slide base gibs and said spring is compressed against said rear slide base ear and retained by said locking pin.

3. A quick detachable gun sight mount mechanism for attaching to a dovetail sight mount having a front dovetail and a rear dovetail to a gun receiver comprising:

a front base having an elongated slot with a cone surface, two screw holes, and a curved lower surface;

a rear slide base having two holes, a tapped hole, a first ear, a second ear, a first gib, a second gib, and a curved surface;

a locking pin having two detents and a notch;

a first spring;

a second spring;

a first ball;

a second ball;

a rear slide having a hole to receive said locking pin, a first passage way and hole for receiving said first ball and said first spring, a second passage way and hole for receiving said second ball and said second spring, a first guide way for receiving said first gib, a second guide way for receiving said second gib, and a slot;

means for attaching said front base to a gun receiver;

means for attaching said rear slide base to said gun receiver;

means for attaching said rear slide to said rear slide base whereby said rear slide guideways slide in said rear slide base gibs and said springs are compressed against said rear slide base ears and retained by said locking pin.

* * * * *